US011684539B2

(12) United States Patent
Ferber et al.

(10) Patent No.: US 11,684,539 B2
(45) **Date of Patent: *Jun. 27, 2023**

(54) PORTABLE BODY MASSAGER

(71) Applicant: FKA Distributing Co., LLC, Commerce Township, MI (US)

(72) Inventors: Roman S. Ferber, West Bloomfield, MI (US); Stephen Chung, Taipei (TW)

(73) Assignee: FKA Distributing Co., LLC, Commerce Township, MI (US)

( * ) Notice: Subject to any disclaimer, the term of this patent is extended or adjusted under 35 U.S.C. 154(b) by 528 days.

This patent is subject to a terminal disclaimer.

(21) Appl. No.: 16/536,540

(22) Filed: Aug. 9, 2019

(65) Prior Publication Data

US 2019/0358116 A1 Nov. 28, 2019

Related U.S. Application Data

(63) Continuation of application No. 15/601,467, filed on May 22, 2017, now Pat. No. 10,413,472, which is a (Continued)

(51) Int. Cl.
*A61H 15/00* (2006.01)
*A61H 7/00* (2006.01)

(52) U.S. Cl.
CPC ..... *A61H 15/0078* (2013.01); *A61H 7/004* (2013.01); *A61H 7/007* (2013.01); (Continued)

(58) Field of Classification Search
CPC .... A61H 15/0078; A61H 7/004; A61H 7/007; A61H 2007/009; A61H 2015/0042; (Continued)

(56) References Cited

U.S. PATENT DOCUMENTS 3,001,523 A 9/1961 Sugimoto
3,374,784 A 3/1968 Brent et al.
(Continued)

FOREIGN PATENT DOCUMENTS

CN 1258212 A 6/2000
CN 2587403 Y 11/2003
(Continued)

OTHER PUBLICATIONS

Chinese Office Action for Application No. 201010557340.6, dated Jul. 22, 2013, 3 pages.
(Continued)

*Primary Examiner* — Quang D Thanh
(74) *Attorney, Agent, or Firm* — Brooks Kushman P.C.

(57) ABSTRACT

A body massager includes a portable housing including a backrest and a seat support. A longitudinal guide is provided in the backrest cooperating with a carriage for translation of the carriage within the backrest and a motor drives the carriage along the guide. A pair of massage members are supported by the carriage and extend from the backrest for imparting a rolling massage effect upon the back of the user. A second motor drives the massage members for generating a rotary kneading massage effect or for adjusting a width of the rolling massage effect.

17 Claims, 5 Drawing Sheets

Related U.S. Application Data continuation of application No. 13/871,549, filed on Apr. 26, 2013, now abandoned, which is a continuation of application No. 12/331,857, filed on Dec. 10, 2008, now abandoned, which is a continuation of application No. 11/205,949, filed on Aug. 17, 2005, now Pat. No. 7,470,242, which is a continuation of application No. 11/084,289, filed on Mar. 18, 2005, now abandoned.

(52) U.S. Cl.
CPC ..... *A61H 2007/009* (2013.01); *A61H 2015/0042* (2013.01); *A61H 2201/0138* (2013.01); *A61H 2201/0149* (2013.01); *A61H 2201/1669* (2013.01); *A61H 2205/081* (2013.01)

(58) Field of Classification Search
CPC .... A61H 2201/0138; A61H 2201/0149; A61H 2201/1669; A61H 2205/081
See application file for complete search history.

(56) References Cited

U.S. PATENT DOCUMENTS 3,633,571 A 1/1972 Shinagawa et al.
4,167,182 A 9/1979 Yamamura et al.
4,373,516 A 2/1983 Masuda et al.
4,412,534 A 11/1983 Hamabe et al.
4,422,448 A 12/1983 Sugai et al.
4,422,449 A 12/1983 Hamabe
4,491,127 A 1/1985 Yamamura et al.
4,505,267 A 3/1985 Inada
4,574,786 A 3/1986 Hashimoto et al.
4,576,149 A 3/1986 Otuka et al.
4,686,967 A 8/1987 Hashimoto et al.
4,718,408 A 1/1988 Barreiro
4,777,940 A 10/1988 Yamasaki
4,785,798 A 11/1988 Yamasaki
5,020,518 A 6/1991 Spears et al.
5,063,911 A 11/1991 Teranishi
5,179,940 A 1/1993 Barreiro
5,183,034 A 2/1993 Yamasaki et al.
5,233,973 A 8/1993 Gill et al.
5,265,590 A 11/1993 Takagi
5,305,738 A 4/1994 Shimizu
5,356,369 A 10/1994 Yamasaki et al.
5,460,598 A 10/1995 Yamasaki et al.
5,462,516 A 10/1995 Anderson
5,464,382 A 11/1995 Wang
5,630,790 A * 5/1997 Ito ..... A61H 1/00 601/102
5,685,827 A 11/1997 Shimizu
5,755,677 A 5/1998 Masuda et al.
5,785,668 A 7/1998 Shimizu
5,792,080 A 8/1998 Ookawa et al.
5,807,288 A 9/1998 Wu
6,039,679 A * 3/2000 Yu ..... A63B 21/00196 482/1
6,056,708 A 5/2000 Sayama et al.
6,077,238 A * 6/2000 Chung ..... A61H 1/00 601/57
6,083,180 A 7/2000 Shimizu
6,110,102 A * 8/2000 Harrison ..... A61H 19/44 600/38
6,200,282 B1 3/2001 Furuie et al.
6,213,962 B1 * 4/2001 Shimizu ..... A61H 15/0078 601/90
6,224,563 B1 5/2001 Nonoue et al.
6,283,928 B1 9/2001 Wang
6,312,400 B1 11/2001 Itikawa et al.
6,402,709 B1 6/2002 Wu
6,443,917 B1 9/2002 Canto
6,503,212 B2 1/2003 Park
6,511,448 B1 1/2003 Furuie et al.
6,517,500 B2 2/2003 Ichikawa
6,629,939 B2 10/2003 Jikiba et al.
6,656,140 B2 12/2003 Oguma et al.
6,749,577 B2 6/2004 Kume et al.
6,790,190 B2 9/2004 Marcantoni
6,805,680 B2 10/2004 Klingler
6,808,500 B1 10/2004 Cheng-Yi et al.
6,814,710 B1 11/2004 Dehli
6,832,991 B1 12/2004 Inada et al.
6,837,861 B2 1/2005 Lin
6,840,914 B1 1/2005 Takamura
6,849,054 B1 2/2005 Kim
6,866,644 B1 3/2005 Kost
6,890,313 B2 5/2005 Kim
6,899,688 B2 5/2005 Wu
6,911,012 B2 6/2005 Kahn
6,916,300 B2 7/2005 Hester et al.
6,979,300 B1 * 12/2005 Julian ..... A61H 7/00 601/15
7,128,721 B2 10/2006 Ferber et al.
7,470,242 B2 12/2008 Ferber et al.
7,731,672 B2 6/2010 Chiang
2001/0044589 A1 * 11/2001 Ferber ..... A61H 33/005 601/168
2002/0138023 A1 9/2002 Kume et al.
2002/0156404 A1 10/2002 Kuo
2003/0009117 A1 1/2003 Zou
2003/0018284 A1 1/2003 Lim
2003/0032903 A1 2/2003 Kasai
2003/0060741 A1 3/2003 Park
2003/0120187 A1 * 6/2003 Kan ..... A61H 37/00 601/99
2003/0199796 A1 10/2003 Yamazaki et al.
2003/0212353 A1 11/2003 Kahn
2003/0212354 A1 11/2003 Kahn
2003/0216673 A1 11/2003 Miki et al.
2003/0216674 A1 11/2003 Miki et al.
2003/0225351 A1 12/2003 Wu
2004/0049136 A1 3/2004 Lin
2004/0082889 A1 4/2004 Wu
2004/0097851 A1 5/2004 Inada et al.
2004/0106882 A1 6/2004 Tseng
2004/0122343 A1 6/2004 Mori et al.
2004/0127823 A1 7/2004 Mori et al.
2004/0158176 A1 8/2004 Park
2004/0158180 A1 8/2004 Liang
2004/0171972 A1 9/2004 Shimizu et al.
2004/0183345 A1 9/2004 Furuie et al.
2004/0186398 A1 9/2004 Furuie et al.
2004/0210174 A1 10/2004 Kim
2004/0211015 A1 10/2004 Chen
2004/0225240 A1 11/2004 Kim
2004/0230145 A1 11/2004 Kim
2004/0236256 A1 11/2004 Kim
2004/0243030 A1 12/2004 Tanizawa et al.
2004/0243033 A1 12/2004 Kim
2004/0243034 A1 12/2004 Kim
2004/0249321 A1 12/2004 Grueger et al.
2004/0260215 A1 12/2004 Kim
2005/0010142 A1 1/2005 Kim
2005/0010143 A1 1/2005 Kim
2005/0010144 A1 1/2005 Chen
2005/0015029 A1 1/2005 Kim
2005/0033204 A1 2/2005 Nakamura et al.
2005/0049530 A1 3/2005 Kim
2005/0049531 A1 3/2005 Kim
2005/0080365 A1 4/2005 Wu et al.
2005/0090770 A1 4/2005 Chen
2005/0090771 A1 4/2005 Miki
2005/0096571 A1 5/2005 Miki
2005/0101890 A1 5/2005 Mizoguchi et al.
2005/0124921 A1 6/2005 Tseng
2005/0137503 A1 6/2005 Hori et al.
2005/0148912 A1 7/2005 Liao
2005/0245851 A1 11/2005 Ferber et al.

(56) References Cited

U.S. PATENT DOCUMENTS

| | | | |
|---|---|---|---|
| 2005/0256434 | A1 | 11/2005 | Luo |
| 2007/0208284 | A1 | 9/2007 | Huang |
| 2007/0299379 | A1 | 12/2007 | Luo |

FOREIGN PATENT DOCUMENTS

| | | | |
|---|---|---|---|
| CN | 2590563 | Y | 12/2003 |
| DE | 9312157 | U | 10/1993 |
| EP | 1000600 | A1 | 5/2000 |
| EP | 1208834 | A1 | 5/2002 |
| EP | 1400230 | A1 | 3/2004 |
| GB | 2123298 | A | 2/1984 |
| GB | 2267440 | A | 12/1993 |
| JP | 5086889 | | 7/1975 |
| JP | 56119251 | A | 9/1981 |
| JP | 5928963 | A | 2/1984 |
| JP | 60135122 | U | 9/1985 |
| JP | 61128971 | A | 6/1986 |
| JP | 06209974 | A | 8/1994 |
| JP | 07080035 | A | 3/1995 |
| JP | 10216187 | A | 8/1998 |
| JP | 2000262575 | A | 9/2000 |
| JP | 2001017494 | A | 1/2001 |
| JP | 2001029419 | A | 2/2001 |
| JP | 2001314470 | A | 11/2001 |
| JP | 2001314471 | A | 11/2001 |
| JP | 2002263155 | A | 9/2002 |
| JP | 2003038591 | A | 2/2003 |
| JP | 2005013548 | A | 1/2005 |
| WO | 9959516 | A1 | 11/1999 |
| WO | 02069880 | A1 | 9/2002 |

OTHER PUBLICATIONS

European Search Report for Application No. 06748449.3, dated Aug. 7, 2008, 9 pages.

Chinese Office Action for Application No. 2006800085094, dated Dec. 18, 2009, 15 pages.

Translation only of Chinese Office Action for Application No. 200680008509.4, dated Jul. 27, 2010, 6 pages.

Japanese Office Action for Application No. 2008-502132, dated Apr. 12, 2011, 5 pages.

Canadian Office Action for Application No. 2,601,407, dated Oct. 1, 2012, 3 pages.

European Search Report for Application No. 10182626.1, dated Jan. 26, 2012, 9 pages.

European Office Action for Application No. 06 748 449.3, dated Jan. 11, 2012, 4 pages.

HoMedics, Shiatsu Massaging Cushion, Moving Massage Mechanism, SMB-200, Instruction Manual and Warranty Information, 2003-2005 HoMedics, Inc., and Figures from Ferber et al. U.S. Pat. No. 7,128,721 B2, 20 pages.

Dr. Scholl's, Look. Feel. Do. Better., 2003, Helen of Troy.

International Search Report for Application No. PCT/US06/09892, dated Aug. 7, 2007, 8 pages.

* cited by examiner

PORTABLE BODY MASSAGER

CROSS-REFERENCE TO RELATED APPLICATIONS

This application is a continuation of U.S. application Ser. No. 15/601,467 filed May 22, 2017, now U.S. Pat. No. 10,413,472 B2, which is a continuation of U.S. application Ser. No. 13/871,549 filed Apr. 26, 2013, now abandoned; which is a continuation of U.S. application Ser. No. 12/331,857 filed Dec. 10, 2008, now abandoned; which is a continuation of U.S. application Ser. No. 11/205,949, filed Aug. 17, 2005, which issued on Dec. 30, 2008 as U.S. Pat. No. 7,470,242 B2; which is a continuation of U.S. application Ser. No. 11/084,289, filed Mar. 18, 2005, now abandoned; the disclosures of which are incorporated in their entirety by reference herein.

TECHNICAL FIELD

The present invention relates to massagers, particularly to portable body massagers.

BACKGROUND

The prior art includes body massagers provided within chairs, as well as in portable cushions. These prior art body massagers commonly include a track or guide for moving a massage assembly longitudinally within the chair or cushion. The prior art body massagers are relatively complex and utilize many components, thereby requiring sufficient structure to support the massager and limiting the portability of the massager. Due to the complexities of conventional body massagers, a consumer's ability to procure such massagers is limited due to value and affordability.

For example, many prior art body massagers include a complex guide system and frame thereby requiring a housing that is sufficiently robust, such as a chair. Accordingly, these drawbacks of the prior art add both cost and weight to the prior art body massagers.

A goal of the present invention is to provide a simplified body massager having improvements in massage function, portability and cost in view of the prior art.

SUMMARY

An aspect of the present invention is to provide a body massager comprising a portable housing having an external contact surface for receiving a portion of a body of a user. A longitudinal guide is mounted in the housing; a carriage is oriented in the housing and cooperates with the guide for limited longitudinal translation. A motor is supported by the carriage or the housing for translating the carriage along the guide. A pair of massage members are supported by the carriage for rotation relative to the carriage for providing a massage effect to the user. A width of the massage members is adjustable by the rotation of the massage members relative to the carriage.

Another aspect of the present invention is to provide a second motor in operable communication with the massage members for rotating the members relative to the carriage.

A further aspect of the present invention is to provide a light source supported by the carriage for illuminating the massage members so the user may view the illuminating massage members through the contact surface.

A further aspect of the present invention is wherein the user can control the operation of the first and second motors to provide a rolling massage effect resulting from continuous operation of the first motor. The rolling massage effect can be provided with width adjustment resulting from user selective operation of the second motor. A rotary kneading massage effect can be provided from continuous operation of the second motor. Longitudinal adjustment of the rotary kneading massage effect may be provided from a user selected operation of the first motor. A rotary kneading massage effect upon the length of the user's body can be provided from continuous operation of the first and second motors.

The above aspects and other aspects, objects, features, and advantages of the present invention are readily apparent from the following detailed description of the preferred embodiment for carrying out the invention when taken in connection with the accompanying brief description of the drawings.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
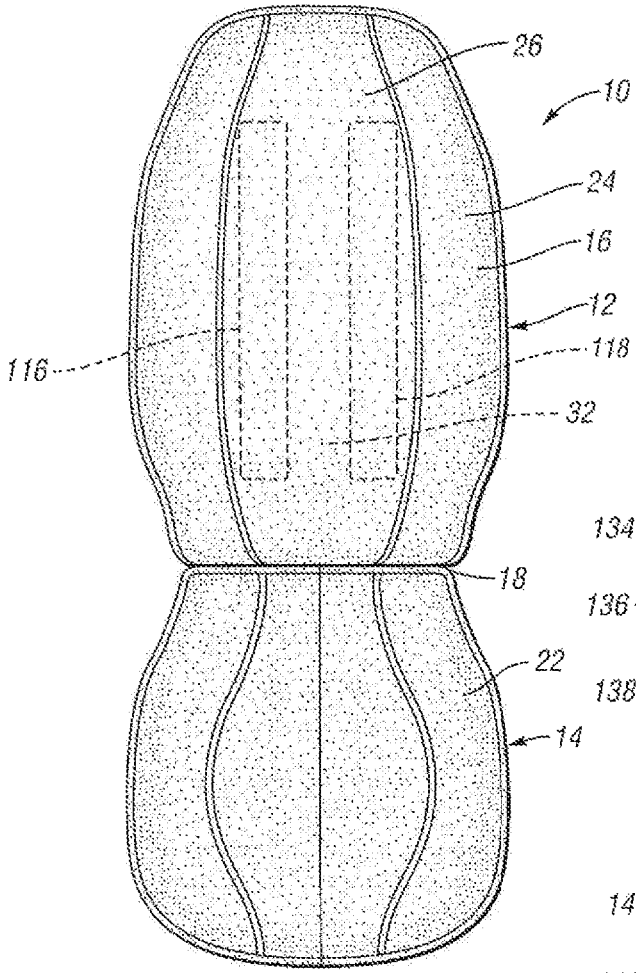
FIG. 1 is an elevation view of a portable body massager in accordance with the present invention.

With reference to FIG. 1, an exemplary embodiment body massager is illustrated in accordance with the present invention and is referenced generally by numeral 10. The body massager 10 includes a backrest region 12 and a seat support region 14. The internal assemblies of the backrest region 12 and the seat support region 14 are collectively retained within a flexible cover 16, which is formed of a high quality vinyl. Of course other materials such as leather may be employed for the cover 16. The cover 16 provides a pivotal connection 18 at a lower longitudinal end of the backrest region 12 and a rearmost end of the seat support region 14. The flexible material of the cover 16 provides a living hinge at the pivotal connection 18 permitting user adjustment of an included angle between the backrest region 12 and the seat support region 14.

Massage effects provided by the body massager 10 include a rolling massage effect and a kneading massage effect provided in the backrest support 12, which is operable to provide the massage effects longitudinally along the length of the backrest region 12. The seat support region 14 provides a vibratory massage effect to the user seated thereupon.

The backrest region 12 is sized to be received upon a backrest of a conventional chair. Likewise, the seat support region 14 is sized to be received upon a seat support of a conventional chair. Additionally, the body massager 10 is portable due to its compact size and light weight so that the user may place the body massager 10 upon a conventional chair for receiving a massage when seated upon the chair. The adjustability of the included angle between the backrest region 12 and the seat support region 14 accommodates a wide range of angles that may be incorporated in conventional chairs.

The backrest region 12 includes a height and width corresponding to the conventional chair and has a thickness that is adequate for housing the massager assembly therein while avoiding disruption of comfort and support provided by the underlying chair. For example, the height of the backrest region 12 may be 650 millimeters, and the width may be 430 millimeters.

Likewise, the seat support region 14 has a width and a depth corresponding to that of the conventional seat support and has a thickness that is adequate for housing the associated massager assembly while avoiding disruption of comfort and support provided by the underlying chair. For example, the seat support region 14 width may be 430 millimeters and the depth may 455 millimeters. Of course, the invention contemplates that the body massager may have dimensions adequate to be received by any conventional chair. However, the dimensions of the preferred embodiment are suitable for most conventional chairs.

Additionally, the backrest region 12 may include a pair of straps mounted from its lateral sides for securing the body massager 10 to the conventional chair, such as the straps disclosed in U.S. patent application Ser. No. 10/836,905, filed on Apr. 30, 2004, titled Portable Body Massager, and issued on Oct. 31, 2006 as U.S. Pat. No. 7,128,721, which is incorporated in its entirety by reference herein.

The seat support region 14 includes a seating surface 22 provided thereon for receiving the user when seated. The backrest region 12 includes a backrest surface 24 for receiving and supporting the back of the user thereupon. The massage assemblies of the backrest region 12 and the seat support region 14 impart the respective massage effects through the backrest surface 24 and seating surface 22 respectively.

A central region 26 of the backrest surface 24 may be formed from a material that is generally transparent so that the user may view the massage assembly housed within the backrest region 12.

Figure 2:
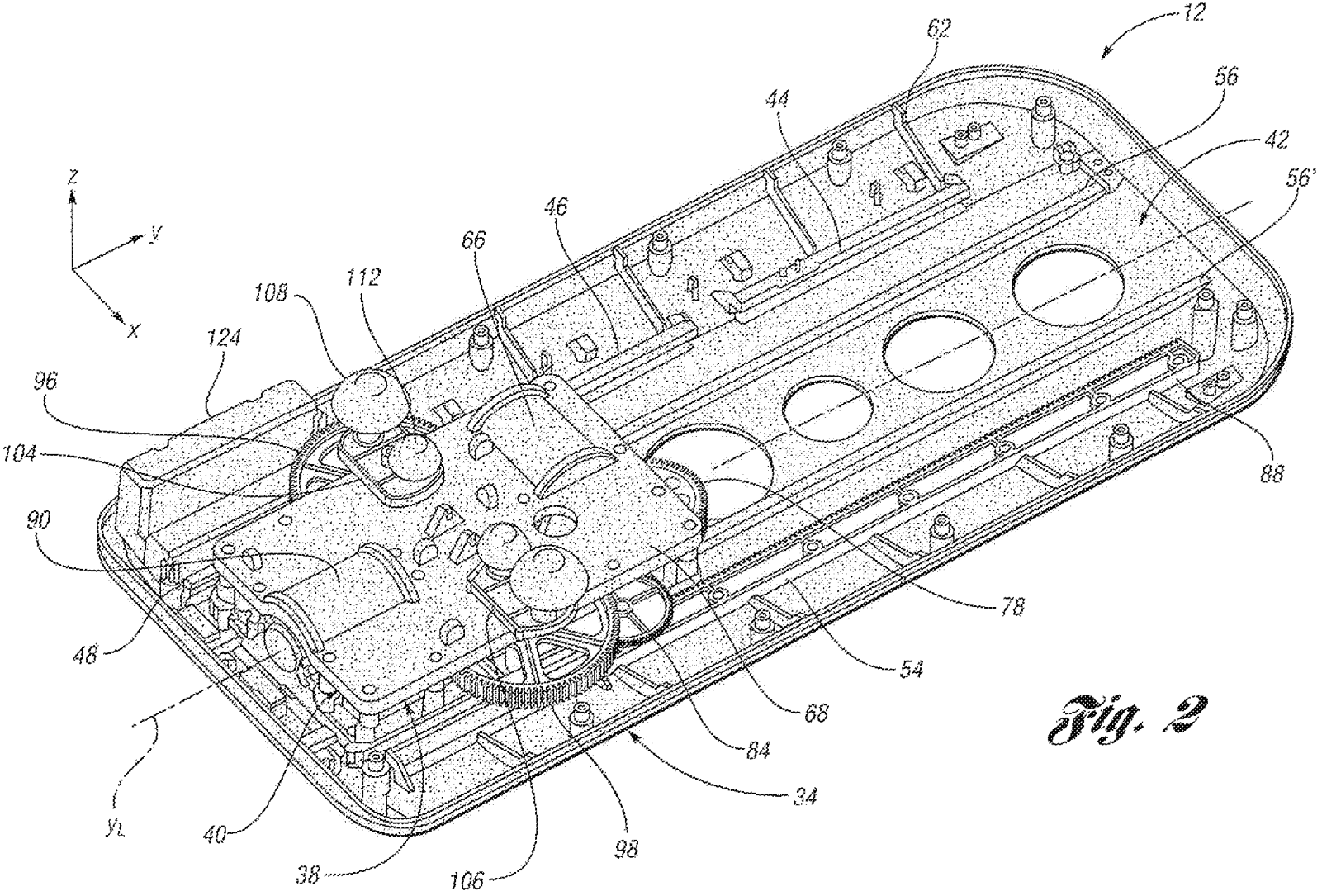
FIG. 2 is a perspective view of a backrest region of the body massager of FIG. 1, illustrated with a portion of a housing partially removed.

The backrest region 12 includes a two piece housing provided by an upper housing portion 32 (FIG. 1) and a lower housing portion 34 (FIG. 2). The upper housing portion 32 and the lower housing portion 34 are sized and adaptable to be secured together by a plurality of fasteners for retaining components of a massage assembly 38 therein.

Referring now to FIG. 2, the massage assembly 38 includes a carriage 40 which cooperates with the lower housing portion 34 for limited longitudinal translation within the backrest region 12. Accordingly, the lower housing portion 34 includes a longitudinal guide 42 mounted therein for cooperating with the carriage 40. The longitudinal direction y is illustrated in FIG. 2 and the housing includes a longitudinal axis yL. The guide 42 includes a series of gibs indicated and referenced as upper gib 44, central gib 46 and lower gib 48. The gibs 44, 46, 48 of the lower housing portion 34 cooperate with and retain a first longitudinal key 50 formed laterally along the carriage 40. The carriage 40 includes a second longitudinal key 52 formed laterally thereupon in transversely spaced opposition to that of the first key 50. A transverse direction x is illustrated in FIG. 2. The second key 52 is retained relative to the lower housing portion 34 by an elongate retainer gib 54 which is secured to the lower housing portion 34 by a series of fasteners.

Figure 3:
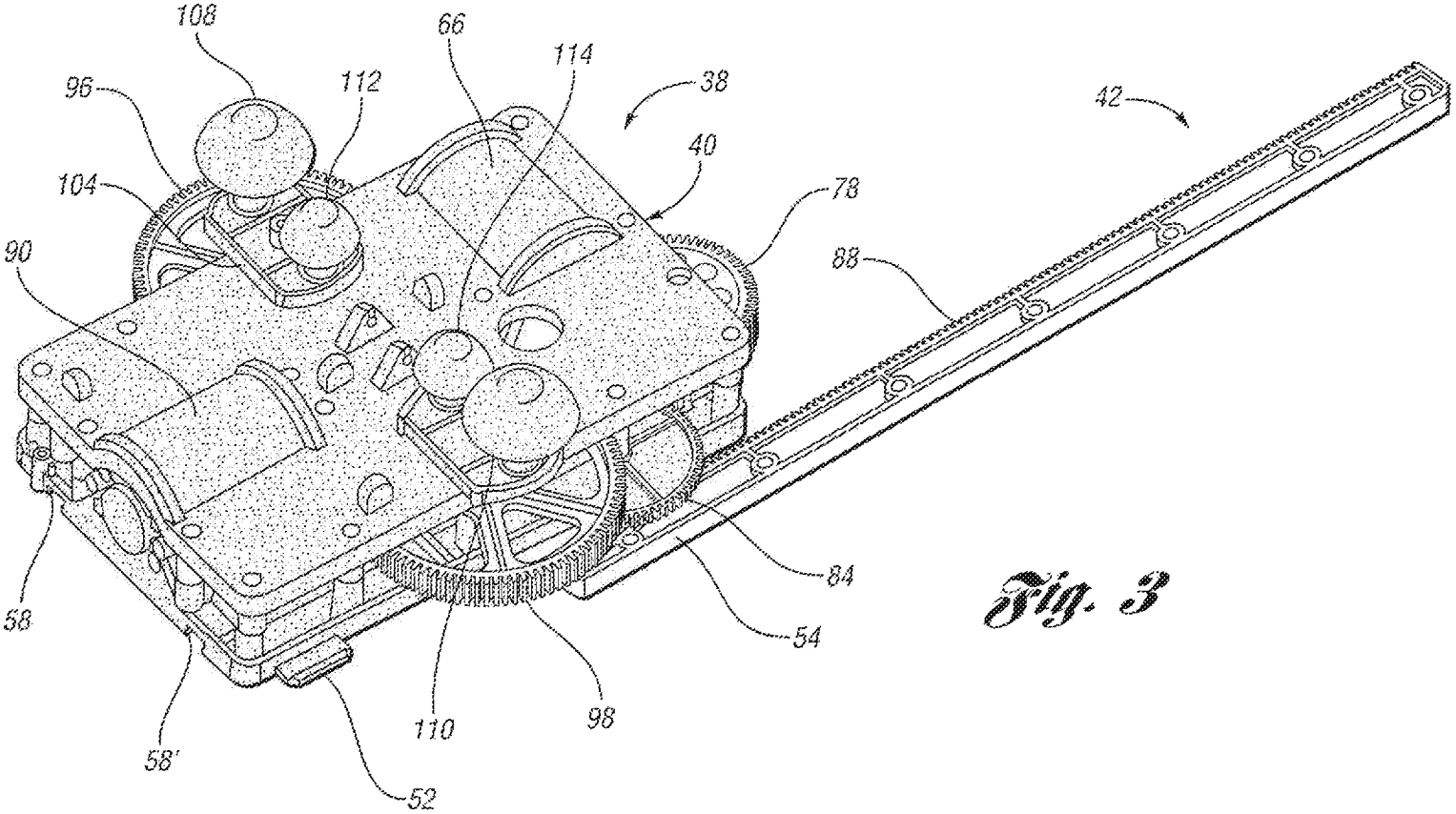
FIG. 3 is an enlarged perspective view of a carriage and a portion of a guide of the body massager of FIG. 1.
Figure 5:
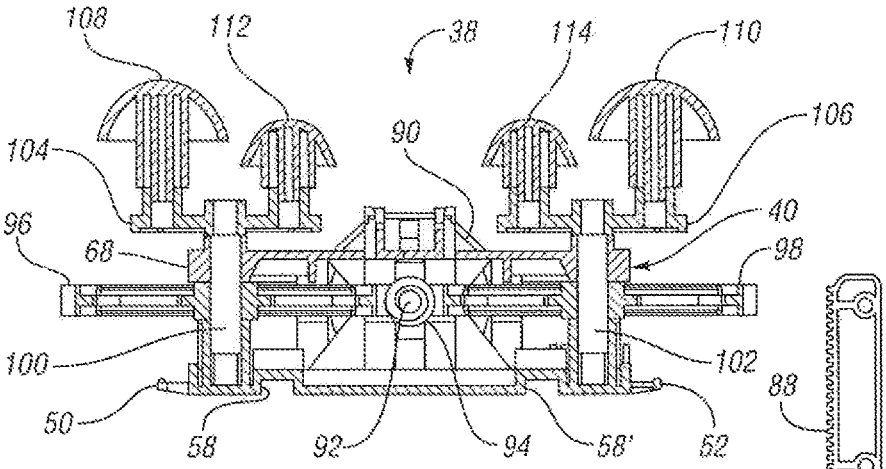
FIG. 5 is a partial section view of the carriage of the body massager of FIG. 1.
Figure 4:
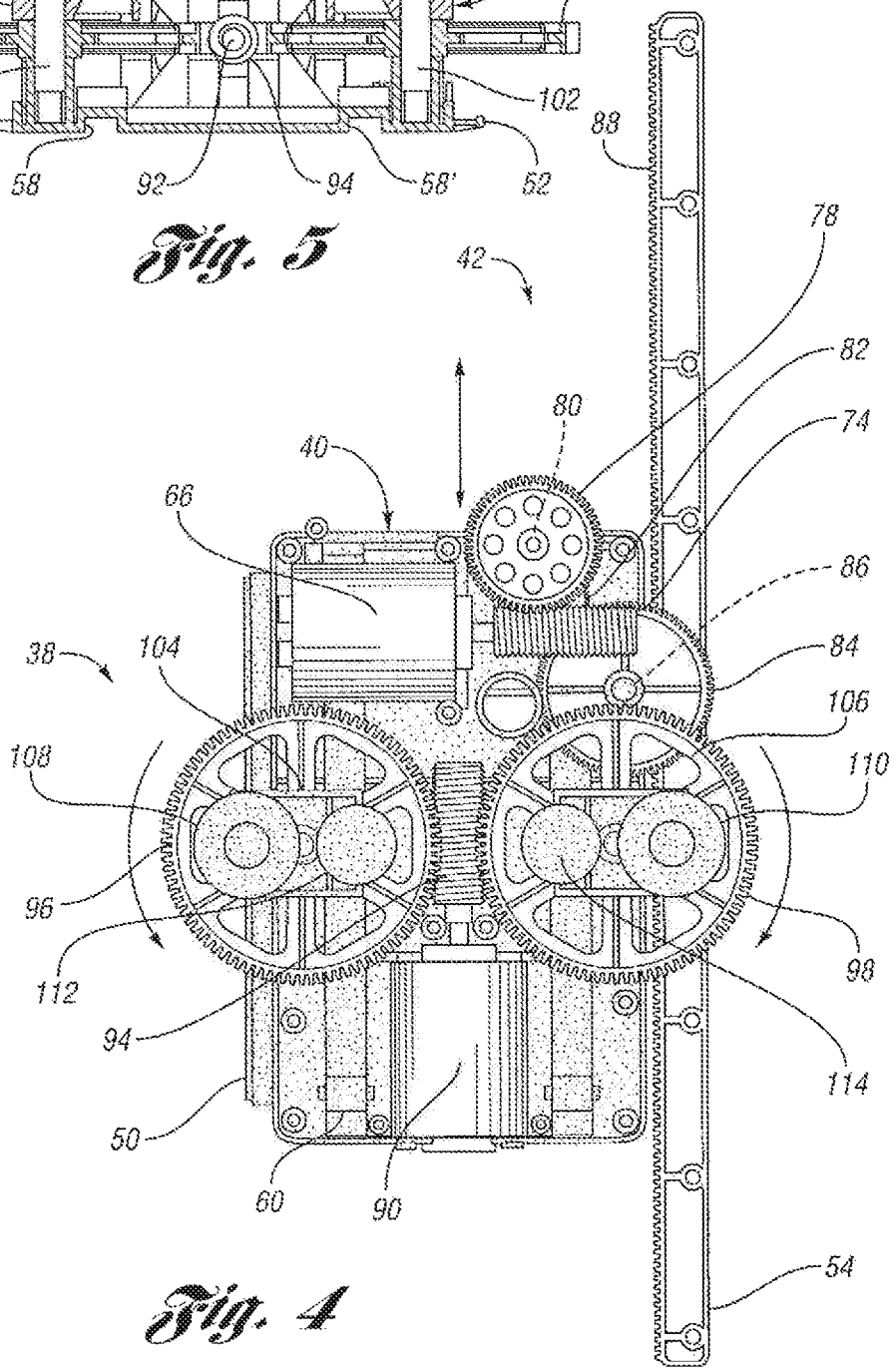
FIG. 4 is a top plan view of the carriage and the guide portion of the body massager of FIG. 1, illustrated with a cover plate removed from the carriage.
Figure 6:
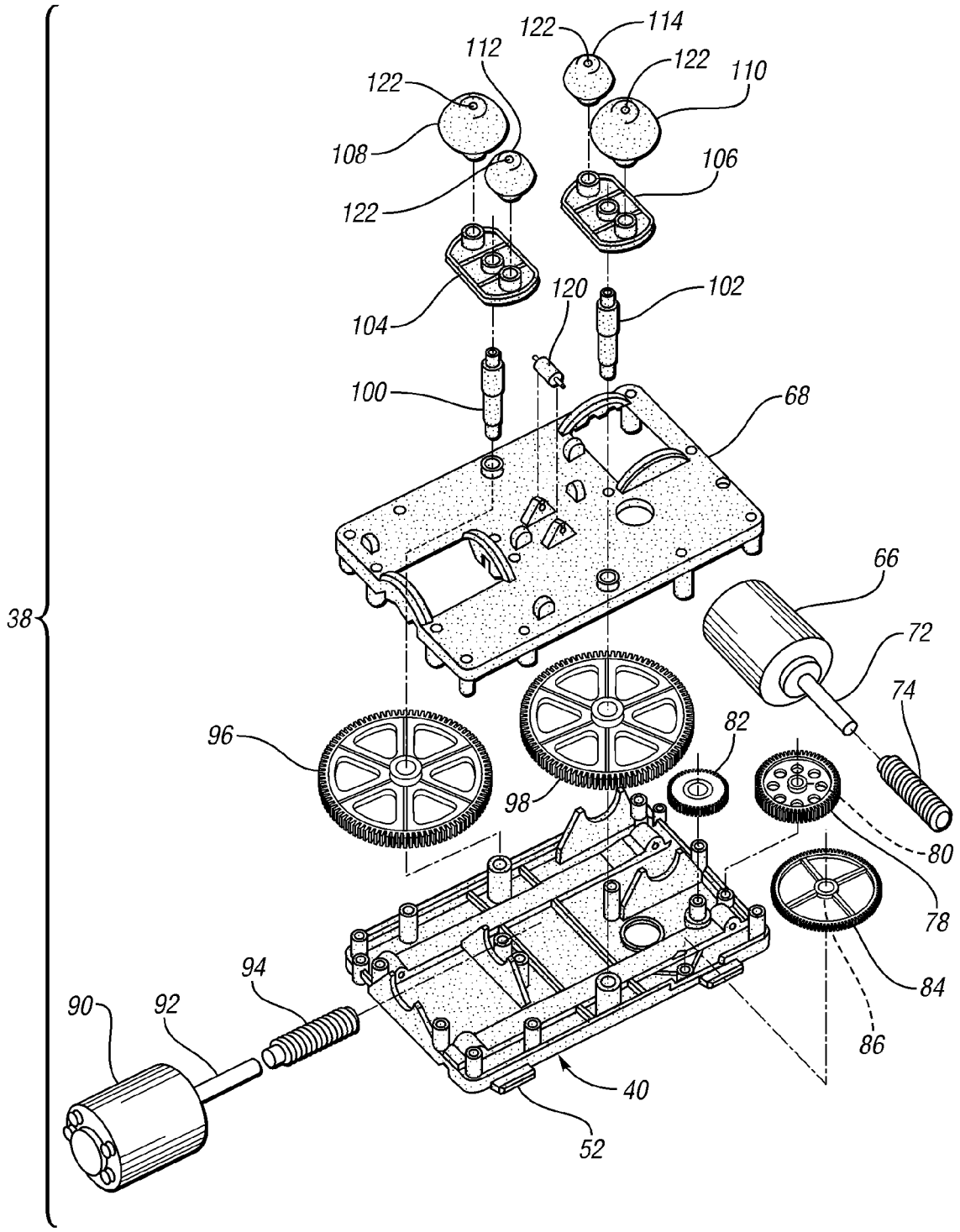
FIG. 6 is an exploded perspective view of the carriage of the body massager of FIG. 1.

The guide 42 of the lower housing portion 34 further comprises a pair of longitudinal rails 56, 56' provided within the lower housing portion 34 and extending upward therefrom. A pair of keyways 58, 58' (FIG. 3) are formed longitudinally through the carriage 40. The keyways 58, 58' are sized to receive the rails 56, 56', respectively. The cooperation of the rails 56, 56' and keyways 58, 58' provides transverse guidance and support to the carriage 40 as it translates along the guide 42. The carriage 40 includes a plurality of roller bearings 60 (FIG. 4), which are each pivotally connected to the carriage 40 and are offset from the keyways 58, 58' and adjacent thereto for engaging a bearing surface provide upon each rail 56, 56'. As the carriage 40 translates along the guide 42, the carriage 40 is bearingly supported by the roller bearings 60 as they engage the surfaces provided by the rails 56, 56'.

With reference again to FIG. 2, the lower housing portion 34 includes a series of ribs 62 formed therein for providing cross support to the lower housing portion 34 and the gibs 44, 46, 48, 54. Accordingly, the two piece housing 32, 34 provides both a housing and a structural frame for the massager assembly 38. Both housing portions 32, 34 are each formed from an injection molding process or the like to provide low weight, yet rigid structural members. Additionally, the upper gib 44, central gib 46, lower gib 48 and rails 56, 56' are integrally formed with the lower housing portion 34 thereby enhancing rigidity and structural cooperation therebetween and minimizing costs in components and assembly.

With reference now to FIGS. 3-6, the massage assembly 38 is illustrated in greater detail. The massage assembly 38 includes a first motor 66, which is mounted to the carriage 40 and retained by a cover plate 68. The cover plate 68 and the carriage 40 collectively define a motor mount for the first motor 66 and are fastened together by a plurality of fasteners. The first motor 66 is operable to translate the carriage 40 along the guide 42 of the lower housing portion 34. The first motor 66 includes a motor output shaft 72 extending from the first motor 66 and driven thereby. A worm 74 is provided on the motor output shaft 72 and fixed relative to the shaft 72. The worm 74 drives a worm gear 78 that is mounted to the carriage 40 for rotation relative to the carriage 40.

A first pinion gear 80 is mounted to the underside of the worm gear 78 and is driven thereby. A first reduction gear 82 is rotatably mounted upon the carriage 40 for rotation about an axis in the z direction. The first reduction gear 82 is engaged with a second reduction gear 84. The second reduction gear 84 is rotatably coupled to the carriage 40 for rotation about an axis in the z direction. A second pinion gear 86 is secured to the underside of the second reduction gear 84. The second pinion gear 86 is engaged to a gear rack 88 formed along the retainer gib 54.

The worm 74, worm gear 78, first pinion gear 80, first reduction gear 82, second reduction gear 84, second pinion gear 86 and gear rack 88 provide a transmission such that rotation from the motor output shaft 72 experiences three stages of reduction for reduced rotation of the second pinion gear 86 relative to the motor output shaft 72. Since the rack 88 is fixed relative to the guide 42, rotation of the second pinion gear 86 translates the carriage 40 along the guide 42. Accordingly, the rotation of the motor output shaft 72 results in translation of the carriage along the guide 42 due to the engagement with the gear rack 88.

The massage assembly 38 also includes a second motor 90, which is mounted to the carriage 40 and retained by the cover plate 68. The cover plate 68 and the carriage 40 collectively define a motor mount for the second motor 90 and are fastened together by a plurality of fasteners. The second motor 90 is operable to impart a massage effect from the massage assembly 38. The second motor 90 includes a motor output shaft 92 extending from the second motor 90 and driven thereby. A worm 94 is provided on the motor output shaft 92 and fixed relative to the shaft 92. The worm 94 drives a pair of worm gears 96, 98 in opposed rotational directions. Each worm gear 96, 98 is secured to a gear shaft 100, 102. The worm 94, the pair of worm gears 96, 98 and gear shafts 100, 102 provide a gearing mechanism. The gear shafts 100, 102 are each rotatably connected to the carriage 40 and the cover plate 68 so that the worm 94 drives the worm gears 96, 98 in opposite rotary directions relative one another in a reduced rotation from that of the second motor 90. The gear shafts 100, 102 extend in direction z, which is perpendicular to both the longitudinal direction y and the transverse direction x.

Each gear shaft 100, 102 extends through the cover plate 68 and receives a massage bracket 104, 106, which are each fastened to the respective gear shaft 100, 102. The massage brackets 104, 106 are transversely spaced about the longitudinal axis yL. Each massage bracket 104, 106 includes a first massage hemispherical node 108, 110 and a second hemispherical massage node 112, 114 mounted to the respective bracket 104, 106.

The gear shafts 100, 102 are oriented perpendicular to the guide 42 and extend in the z direction towards the backrest surface 24. The massage nodes 108, 110, 112, 114 are each rotatable relative to the respective massage bracket 104, 106 about an axis that is offset from that of the respective gear shaft 100, 102. The massage nodes 108, 110, 112, 114 extend through a corresponding aperture 116, 118 (FIG. 1) formed through a central region 26 of the housing upper portion 32 for imparting the massage effect to the user through the cover 16. As the massage nodes 108, 110, 112, 114 revolve around the corresponding gear shaft 100, 102, a rotary kneading massage effect is imparted upon the user, which is commonly referred to as a Shiatsu massage.

Each massage node 108, 110, 112, 114 is rotatably connected to the corresponding massage bracket 104, 106 to reduce friction generated in the rotary kneading massage effect. Further, if the first motor 66 is in operation while the second motor 90 is not in operation, the massage nodes will be translated in engagement along the body part of the user. The rotatable connection permits the massage nodes 108, 110, 112, 114 to roll along the body part, thereby creating a rolling massage effect.

Additionally, the first massage nodes 108, 110 have an overall height in the z direction greater than that of the second massage nodes 112, 114 to extend further from the corresponding massage brackets 104, 106. The first massage nodes 108, 110 also have a diameter greater than that of the second massage nodes 112, 114. These variations are utilized for varying the engagement of the rotary kneading effect with the user, resulting in a kneading effect that is nonsymmetrical and similar to a massage provided by the hands of a skilled massage therapist. Additionally, these variations result in a nonsymmetrical rolling massage effect as the nodes 108, 110, 112, 114 are rolled along the body.

The apertures 116, 118 formed through the upper housing portion 32 are generally elongate for permitting the massage nodes 108, 110, 112, 114 to pass therethrough as the carriage 40 is translated relative to the guide 42. Further, the cover plate 68 includes a roller bearing 120 (FIG. 6) pivotally connected thereto for engaging an underside bearing surface formed within the upper housing portion 32, thus providing bearing support between the carriage 40 and the upper housing portion 32. Accordingly, loading imparted upon the backrest surface 24 is translated through the upper housing portion 32 to the carriage 40 through the roller bearing 120, to the lower housing portion 34 through the roller bearings 60 for providing bearing support therebetween and preventing such loading from inhibiting the translation of the carriage 40 along the guide 42.

Due to the translation of the carriage 40 and the first and second motors 66, 90, cord management may be necessary to ensure that a power cord, which provides power to the first and motors 66, 90 does not interfere with, nor get damaged by the operations of the massage assembly 38. Accordingly, a longitudinal bar may be provided within the backrest region 12 mounted to the lower housing portion 34 as disclosed in the U.S. patent application Ser. No. 10/836,905, which was incorporated by reference. The power cord is coiled about the bar for extension and retraction thereabout as the carriage 40 is translated along the guide 42.

The first motor 66 is directly coupled to the associated transmission for translation of the carriage 40 when the first motor 66 is powered. In order to reverse direction of the carriage 40, the rotational direction of the first motor 66 is reversed as well. In order to control the reversal of power to the first motor 66, a series of limit switches are provided along the guide 42. Limit switches, and the placement and operation of the limit switches are disclosed in U.S. patent application Ser. No. 10/836,905, which has been incorporated by reference herein. The signals provided by the limit switches are processed by a central processing unit provided at a circuit board 124, mounted within the backrest region 12 to the lower housing portion 34 as illustrated in FIG. 2.

Figure 7:
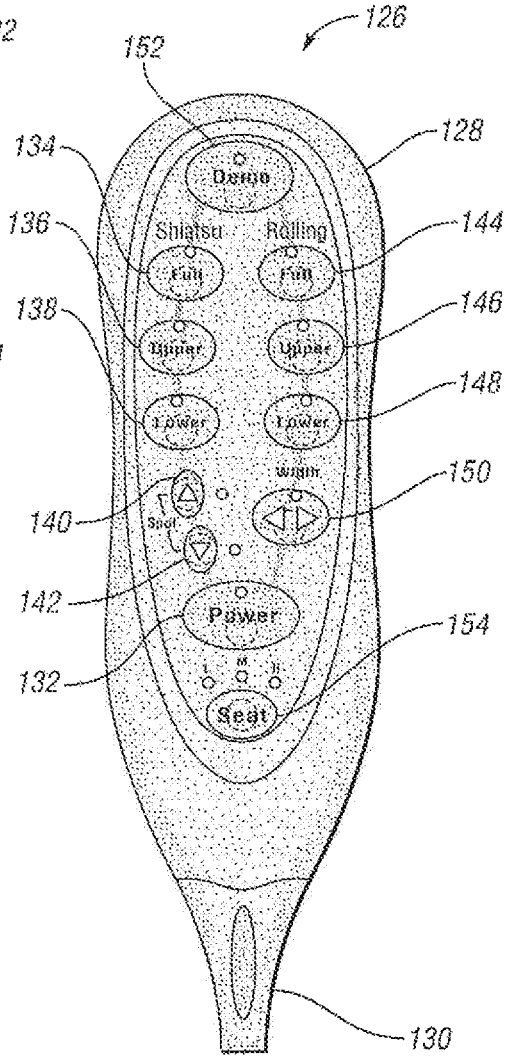
FIG. 7 is an elevation view of a remote control for the body massager of FIG. 1.

The user operates the massage assembly 38 via a control pad provided on the body massager 10. Referring now to FIG. 7, a remote control 126 is provided as the control pad for controlling the operations. The remote control 126 includes a body 128 that is sized to be grasped by the user, and a tether 130, which secures the body 128 to the body massager 10 and is wired to the circuit board 124 for operable communication therewith.

The remote control includes a power button 132 for turning the body massager on and off. The remote control also includes controls for the rotary kneading massage effect and the rolling massage effect provided from the massage assembly 38. Each button includes an LED for indicating that the associated function is in operation.

A full rotary kneading (or Shiatsu) massage effect button 134 is provided for selecting a rotary kneading massage effect to the full longitudinal range of the guide 42. In this operation, the second motor 90 is driven continuously for imparting a continuous rotary kneading massage effect. Additionally the first motor 66 is driven continuously for continuous translation of the carriage 40 along the guide 42. Upon the carriage reaching a limit in the overall travel along the guide 42, a corresponding limit switch indicates that the limit has been reached and the circuit board 124 reverses the rotation of the first motor 66 so that the carriage 40 reverses its direction of travel along the guide 42.

An upper rotary kneading massage effect button 136 and a lower rotary kneading massage effect button 138 are also provided for controlling a rotary kneading massage effect to a targeted range as defined by the limit switches. In each of these ranges, the second motor 90 is driven continuously for providing a rotary kneading massage effect, and the first motor 66 is driven continuously for translating the carriage 40 within the range. Upon the carriage 40 reaching a limit within the range, the rotation of the first motor 66 is reversed thereby reversing the direction of the carriage 40.

The remote control 126 further includes an upward targeted rotary kneading massage effect button 140 and a lower targeted rotary kneading massage effect button 142 for providing the rotary kneading massage effect to a targeted point upon the user's body. Upon actuation of one of these buttons 140, 142, the second motor 90 is driven continuously for providing a continuous rotary kneading massage effect. As either of these buttons 140, 142 is depressed by the user, the first motor 66 is driven in a direction corresponding to the depressed button 140, 142 for translating the carriage 40 to a user selected orientation. Upon reaching the user selected position, the user removes his or her finger from the button 140, 142 thereby discontinuing operation of the first motor 66 so that the carriage 40 stops at the selected position; and the second motor 90 continues to drive the rotary kneading massage effect.

A full rolling massage effect button 144 is provided on the remote control 126 for providing a full rolling massage effect. For this effect, the first motor 66 is driven continuously and the second motor 90 is not driven so that the nodes 108, 110, 112, 114 are stationary in orientation relative to the carriage 40 for rolling relative to the carriage 40 for providing a rolling massage effect upon the body of the user. The first motor 66 is driven in a first rotary direction until the carriage 40 engages the limit within the range of travel. Upon reaching this limit, the rotation of the first motor 66 is reversed thereby reversing the direction of the carriage 40.

An upper rolling massage effect button 146 and a lower rolling massage effect button 148 are also provided for providing the rolling massage effect within a targeted range as set forth by the limit switches along the guide 42.

A bidirectional width adjustment button 150 is also provided on the remote control 126 so that as the user is experiencing a rolling massage effect, as selected by one of the rolling massage effect buttons 144, 146, 148, the user may adjust the width of the massage nodes 108, 110, 112, 114. Specifically, the width adjustment button 150 controls the operation of the second motor 90 for the user selected duration. Thus, if the user depresses the width adjustment button 150 in one direction, the second motor 90 is driven in a first rotary direction while the button 150 is depressed. Upon releasing the width adjustment button 150, the operation of the second motor 90 is discontinued. Additionally, by depressing the width adjustment button 150 in a second direction, the second motor 90 is driven in a reversed rotary direction.

The width adjustment button 150 permits the user to adjust the rotary orientation of the nodes 108, 110, 112, 114 as the carriage 40 is driven along the guide 42. This rotary adjustment of the orientation of the nodes 108, 110, 112, 114 thereby adjusts the rotary orientation of the nodes 108, 110, 112, 114, which consequently adjusts the width of the nodes 108, 110, 112, 114 relative to the longitudinal axis yL.

The remote control 126 further includes a demo button 152 for providing a demonstration operation of various combinations of the massage effects provided by the kneading and rolling buttons 134, 136, 138, 140, 142, 144, 146, 148, 150 so that the user experiences a variety of massage effects.

Briefly, the massage effects are generated from the simplified massage assembly 38. Rotary kneading massage effects and width adjustment of rolling massage effects are both provided from a common motor by continuous or user selected rotation of the nodes 108, 110, 112, 114. Accordingly, width adjustment of the nodes 108, 110, 112, 114 is provided within the body massager 10 without limiting the portability and weight of the massager 10, and without requiring a third motor.

Additionally, the massage nodes 108, 110, 112, 114 may include light emitting diodes (LED's) 122 (FIG. 6) disposed therein for illuminating each node 108, 110, 112, 114. The illuminated massage nodes 108, 110, 112, 114 generate a mobile illuminated visual effect through a partially transparent cover 16. The upper housing portion 32 may be partially transparent for permitting the user to view the operation of the massage assembly. The cover plate 68 may also be partially transparent for permitting the user to view the operation of the components of the massage assembly 38.

The remote control 126 also includes a seat massage button 154 for imparting a massage effect to the seat bottom region 14. As disclosed in U.S. patent application Ser. No. 10/836,905, vibratory massage assemblies may be provided within the seat support region 14. The seat massage button 154 may be depressed multiple times to change the operation between a low, medium and high magnitude of vibratory massage from the massage assemblies. The intensity of the vibratory massage is controlled by the speed of the motors. The demo button 152 may include demonstrative massage effects that include various amplitudes of vibratory massages from the seat support region 14.

In summary, the body massager 10 provides an efficient, portable, lightweight, sturdy massage apparatus which generates various types of massages to various areas of the body with operational variations thereof so that the user may experience a variety of massage effects or desired targeted massage effects, while minimizing the size and costs of the overall massager.

While embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A portable body massager comprising:

a portable housing sized to be received and supported by a backrest of a conventional chair, the housing having a partially transparent external contact surface to receive a portion of a body of a user;

a longitudinal guide mounted in the housing;

a carriage oriented in the housing and cooperating with the guide for limited longitudinal translation in the housing along the guide;

a motor supported upon the carriage and operably coupled to the housing to translate the carriage along the guide;

at least one massage member supported by the carriage to impart a massage effect upon the portion of the user's body as the carriage is translated relative to the housing;

a light source provided on the at least one massage member to convey an illumination effect from the at least one massage member;

wherein the housing has a longitudinal axis;

wherein the motor is further defined as a first motor, the motor comprising a motor output shaft driven thereby, the motor output shaft being operably coupled to the housing to translate the carriage along the guide;

wherein the at least one massage member comprises at least a pair of massage members transversely spaced about the longitudinal axis;

a second motor supported upon the carriage in operable communication with the at least a pair of massage members to drive the at least a pair of massage members relative to the carriage to provide a kneading massage effect to the user's body corresponding to a longitudinal orientation of the carriage and a gearing mechanism for user-selected operation of the at least a pair of massage members relative to the carriage providing selective orientation adjustment of the at least a pair of massage members relative to the longitudinal axis independently of translation of the carriage along the guide so that the user selects a stationary orientation of the at least a pair of massage members to impart the massage effect;

a transmission comprising:

a worm mounted to and driven by the motor output shaft;

a worm gear rotatably mounted to the carriage and operably driven by the worm;

a pinion gear rotatably mounted to the carriage and operably driven by the worm gear;

a longitudinal rack affixed to the housing and engaged with the pinion gear such that rotation of the pinion gear translates the carriage along the guide;

wherein the orientation adjustment of the at least a pair of massage members is controlled from a control pad; and wherein operation of the first motor further comprises user-selected rotation to translate the carriage to a desired longitudinal orientation.

2. The portable body massager of claim 1 wherein operation of the first motor further comprises continuous rotation of the at least a pair of massage members within a range of translation of the carriage to provide a rotary massage effect from the at least a pair of massage members.

3. The portable body massager of claim 2 wherein the operation of the first motor and the second motor is controlled from the control pad.

4. The portable body massager of claim 1, wherein the transmission is in cooperation with the first motor, the housing, and the carriage, and wherein operation of the first motor operates the transmission to translate the carriage to the desired longitudinal orientation.

5. The portable body massager of claim 1 wherein each of the at least a pair of massage members is supported for rotation relative to the carriage.

6. The portable body massager of claim 1 wherein each of the at least a pair of massage members further comprises:

a bracket rotatably mounted to the carriage;

a primary massage node rotatably mounted to the bracket about an axis of rotation that is not coaxial with an axis of rotation of the bracket, so that the primary massage node is rotatable relative to the bracket to provide a rolling massage effect; and a secondary massage node rotatably mounted to the bracket about an axis of rotation that is not coaxial with the axis of rotation of the bracket and the axis of rotation of the primary massage node, so that the secondary massage node is rotatable relative to the bracket to provide a rolling massage effect, the secondary massage node being smaller than the primary massage node so that the rolling massage effect of the secondary massage node differs from that of the primary massage node.

7. The portable body massager of claim 1 wherein the at least one massage member is supported for rotation relative to the carriage; and wherein the second motor cooperates with the at least one massage member to continuously rotate the at least one massage member relative to the carriage to provide a rotary kneading effect to a targeted region of the user's body corresponding to a longitudinal orientation of the carriage.

8. The portable body massager of claim 1 wherein each of the at least a pair of massage members is supported for rotation relative to the carriage; and wherein the second motor cooperates with the at least a pair of massage members to continuously rotate the at least a pair of massage members relative to the carriage to provide a rotary kneading effect to a targeted region of the user's body corresponding to a longitudinal orientation of the carriage.

9. The portable body massager of claim 1 wherein each of the at least a pair of massage members is supported for rotation relative to the carriage; and wherein the second motor cooperates with the at least a pair of massage members to rotate the at least a pair of massage members relative to the carriage.

10. The portable body massager of claim 1 wherein operation of the second motor further comprises continuous rotation to provide a continuous rotary kneading effect of the at least a pair of massage members.

11. The portable body massager of claim 1 wherein operation of the second motor further comprises continuous operation to provide a continuous kneading massage effect of the the at least a pair of massage members.

12. The portable body massager of claim 1 wherein each of the at least a pair of massage members provides a Shiatsu massage.

13. The portable body massager of claim 1 wherein the light source further comprises at least one light emitting diode.

14. The portable body massager of claim 1 wherein the light source generates a mobile illuminated visual effect.

15. The portable body massager of claim 1 wherein each of the at least a pair of massage members comprises at least one massage node.

16. The portable body massager of claim 15 wherein the light source further comprises a plurality of light emitting diodes mounted to each of the at least a pair of massage members to illuminate the at least one massage node.

17. The portable body massager of claim 1 wherein the transmission is a multistage transmission driven by the first motor and cooperating with the housing to translate the carriage along the guide, wherein at least one gear of the multistage transmission rotates about an axis that is generally perpendicular to both the longitudinal axis of the housing and a transverse axis of the housing.

* * * * *